US006908258B2

(12) United States Patent
Timmerman

(10) Patent No.: US 6,908,258 B2
(45) Date of Patent: Jun. 21, 2005

(54) METHODS AND APPARATUS FOR MAINTAINING SEAWALLS

(76) Inventor: James E. Timmerman, 831 Perrine Ct., Marco Island, FL (US) 34146

( * ) Notice: Subject to any disclaimer, the term of this patent is extended or adjusted under 35 U.S.C. 154(b) by 0 days.

(21) Appl. No.: 10/617,206

(22) Filed: Jul. 11, 2003

(65) Prior Publication Data

US 2005/0008439 A1 Jan. 13, 2005

(51) Int. Cl.[7] ..... E02D 29/02

(52) U.S. Cl. ..... 405/31; 405/262; 405/284; 405/285; 403/175

(58) Field of Search ..... 405/31, 262, 284, 405/285, 286, 287; 403/175, 218, 178

(56) References Cited

U.S. PATENT DOCUMENTS

| | | | | |
|---|---|---|---|---|
| 1,270,659 A | | 6/1918 | Ravier | |
| 1,876,720 A | * | 9/1932 | Merrill | 403/43 |
| 3,371,494 A | | 3/1968 | Lagerström | |
| 3,490,242 A | * | 1/1970 | Schnabel, Jr. | 405/262 |
| 3,541,798 A | * | 11/1970 | Schnabel, Jr. | 405/262 |
| 3,802,204 A | * | 4/1974 | Mason | 405/262 |
| 3,815,368 A | | 6/1974 | Turzillo | |
| RE28,977 E | * | 9/1976 | Mason | 405/262 |
| 3,999,398 A | * | 12/1976 | Kurose | 405/262 |
| 4,036,026 A | * | 7/1977 | Asayama | 405/262 |
| 4,069,677 A | * | 1/1978 | Yamada et al. | 405/259.5 |
| 4,124,983 A | * | 11/1978 | Weatherby | 405/259.5 |
| 4,132,498 A | * | 1/1979 | Ikeda et al. | 405/259.4 |
| 4,189,891 A | | 2/1980 | Johnson et al. | |
| 4,253,781 A | | 3/1981 | Fischer et al. | |
| 4,480,945 A | | 11/1984 | Schnabel, Jr. | |
| 4,499,698 A | | 2/1985 | Hoyt et al. | |
| 4,674,921 A | * | 6/1987 | Berger | 405/262 |
| 4,711,604 A | | 12/1987 | Heimsoth et al. | |
| 4,728,225 A | | 3/1988 | Brandl et al. | |
| 4,911,582 A | | 3/1990 | Peirce, Jr. et al. | |
| 4,970,835 A | | 11/1990 | Harmon | |
| 5,011,366 A | | 4/1991 | Miller | |
| 5,120,163 A | | 6/1992 | Holdeman et al. | |
| 5,139,368 A | | 8/1992 | Hamilton et al. | |
| 5,171,107 A | | 12/1992 | Hamilton et al. | |
| 5,213,448 A | | 5/1993 | Seider et al. | |
| 5,580,191 A | * | 12/1996 | Egan | 405/262 |
| 5,927,905 A | | 7/1999 | van Halteren | |
| 5,971,669 A | * | 10/1999 | Crigler | 405/284 |

FOREIGN PATENT DOCUMENTS

JP 08028045 * 1/1996

OTHER PUBLICATIONS

Chance® Company website print–out, 3 pages, Jul. 29, 2002.

Foresight Products, LLC website print–out, 12 pages, Sep. 18, 2002.

* cited by examiner

*Primary Examiner*—Jong-Suk (James) Lee

(57) ABSTRACT

Apparatus for maintaining a seawall disposed between a body of water and retained earth includes at least two anchoring devices installed on the seawall at spaced locations and a connecting member for rigidly interconnecting the anchoring devices to maintain the separation distance therebetween. The connecting member may have a fixed length or may be adjustable in length to adjust the separation distance between the anchoring devices. A method of maintaining a seawall involves forming a passage through the seawall from a water facing side to an earth facing side of the seawall, inserting an anchoring member in the passage, advancing the anchoring member into the retained earth to anchor an anchor of the anchoring member in the retained earth, and securing a retaining member on the anchoring member along the water facing side of the seawall to apply compressive force against the seawall.

32 Claims, 5 Drawing Sheets

METHODS AND APPARATUS FOR MAINTAINING SEAWALLS

BACKGROUND OF THE INVENTION

1. Field of the Invention

The present invention relates generally to the maintenance of seawalls disposed between bodies of water and retained earth and, more particularly, to methods and apparatus for maintaining seawalls using anchoring devices to strengthen the seawalls to resist potential damage and/or repair actual damage in the seawalls.

2. Discussion of the Related Art

Seawalls are commonly disposed between bodies of water and earth to provide physical boundaries between the bodies of water and the earth and to support or retain the earth by resisting the pressure of the retained earth against the seawalls. Seawalls can be used to separate earth from various types of bodies of water of various sizes and depths. Seawalls can be constructed in various ways and of various materials. Typically, seawalls have a vertical span or height sufficient for an upper end of the seawall to normally extend above the water with a lower end or toe portion of the seawall embedded in the earthen floor to extend below the body of water. The distance that a seawall extends above the water may vary depending on the height of the retained earth above the water and/or anticipated fluctuations in water level. The depth to which the embedded toe portion extends below the water may vary in accordance with the vertical span of the seawall and/or the depth of the body of water to provide sufficient support for the seawall to resist movement from the pressure of the retained earth against the seawall. Accordingly, seawalls are usually designed for a particular depth body of water. The thickness of seawalls may vary depending on site-specific loads and other engineering parameters. One representative type of seawall comprises concrete panels about ten to fifteen feet high, about four feet wide and about three to five inches thick disposed in side by side abutment to form a continuous wall.

Since the earth exerts greater pressure against seawalls than the water, seawalls are oftentimes damaged or destabilized during their lifetimes as evidenced, for example, by movement, displacement, shifting, cracking and/or misalignment of the seawalls. Sometimes seawalls are placed at risk for damage or instability due to a change in conditions occurring subsequent to installation of the seawalls. For instance, if a body of water is dredged resulting in a greater depth body of water and a lesser depth of penetration for the toe portion of an existing seawall, the lesser depth of penetration for the toe portion may no longer be sufficient for the seawall to support the pressure of the retained earth such that the seawall is susceptible to damage or instability. In some cases, the height of the retained earth on the earth facing side of an existing seawall may be increased, causing increased pressure of retained earth against the seawall by which the seawall may be damaged or destabilized. In addition to the pressures of retained earth, seawalls may be damaged or destabilized directly or indirectly due to other conditions including collisions or other impacts, corrosion, environmental factors, and age. Since removal and replacement of damaged and/or unstable seawalls involves significant cost and disruption, it is preferable to strengthen existing seawalls to repair and/or avoid damage or instability.

It has been proposed to strengthen seawalls to resist movement using anchors or tie rods in conjunction with cementitious material as represented by U.S. Pat. No. 1,270,659 to Ravier, U.S. Pat. No. 4,480,945 to Schnabel, Jr., U.S. Pat. No. 4,711,604, to Heimsoth et al., and U.S. Pat. No. 4,728,225 to Brandl et al. U.S. Pat. No. 3,371,494 to Lagerstrom, U.S. Pat. No. 4,253,781 to Fischer et al., and U.S. Pat. No. 4,911,582 to Pierce, Jr. et al. disclose the use of anchors or tie rods in conjunction with cementitious material to restrain structural walls other than seawalls. Helical anchors for building constructions are represented by U.S. Pat. No. 4,499,698 to Hoyt et al., U.S. Pat. No. 5,011,366 to Hamilton, et al., U.S. Pat. No. 5,120,163 to Holdeman et al., U.S. Pat. No. 5,139,368 and U.S. Pat. No. 5,171,107 to Hamilton et al., U.S. Pat. No. 5,213,448 to Seider et al., and U.S. Pat. No. 5,927,905 to van Halteren.

Prior apparatus and methods for repairing and/or strengthening seawalls and other retaining walls have various disadvantages including complicated structure and installation steps, major disruption, the need for excavating and/or disturbing the earth, partial or complete demolition of existing walls, the need to temporarily hold back or contain water during installation, the need to install additional and/or replacement wall structure, the use of cementitious material to assist in anchoring, the need for backfill, and the inability to execute installation from a body of water. Prior apparatus and methods which require earth-side access are untenable where homes or other buildings are situated close to seawalls making it undesirable and even prohibitive to disturb the earth on the earth facing sides of the seawalls and/or to conduct seawall maintenance from the earth facing sides. Prior apparatus and methods for repairing and/or strengthening seawalls and other retaining walls using anchors or tie rods generally lack the ability to rigidly interconnect a plurality of spaced anchors or tie rods installed in a wall to maintain the spacing between the anchors or tie rods in a desired direction. Furthermore, prior apparatus and methods for repairing and/or maintaining seawalls and other retaining walls using anchors or tie rods do not allow a plurality of spaced anchors or tie rods installed in a wall to be adjustably interconnected to adjust the spacing between the anchors or tie rods. Prior apparatus and methods for repairing and/or strengthening seawalls and other retaining walls do not contemplate closing openings in the walls by adjustably moving the walls between interconnected anchors or tie rods installed in the walls on opposite sides of the openings.

Accordingly, there is a need for apparatus and methods for maintaining seawalls by repairing and/or strengthening the seawalls utilizing anchoring devices having anchoring members installed from the water facing sides of the seawalls to extend through the seawalls into the retained earth and retaining members secured to the anchoring members along the water facing sides of the seawalls without the need for excavation and/or disturbance of the earth, removal of existing seawalls or seawall portions and/or the installation of additional seawalls or seawall portions, and without the need for backfill, cementitious material and water containment while having simplified structure and installation steps. There is also a need for apparatus and methods for maintaining seawalls by which at least a pair of spaced anchoring members extending through a seawall may be rigidly secured in interconnected relation to maintain the spacing between the interconnected anchoring members. Another need exists for apparatus and methods for maintaining seawalls by which at least a pair of spaced anchoring members extending through a seawall may be adjustably interconnected to adjust the spacing between the interconnected anchoring members. A need further exists for apparatus and methods for maintaining seawalls by which anchoring members installed in a seawall on opposite sides of an opening in the seawall may be interconnectedly drawn toward one another to close the opening.

SUMMARY OF THE INVENTION

Accordingly, it is an object of the present invention to overcome the aforementioned disadvantages of prior apparatus and methods for maintaining seawalls.

Another object of the present invention is to strengthen a seawall utilizing one or more anchoring devices each including an anchoring member having a shaft installed to extend through the seawall from a water facing side thereof and an anchor anchored in earth on an earth facing side of the seawall, and a retaining member secured on the shaft along the water facing side of the seawall.

It is also an object of the present invention to restrain a seawall against movement due to pressure of retained earth on an earth facing side of the seawall by compressing the seawall between a retaining member secured on a shaft of an anchoring member extending through the seawall and an anchor of the anchoring member embedded in the retained earth.

The present invention has as an additional object to adjustably compress a seawall between an anchor of an anchoring member embedded in retained earth on an earth facing side of the seawall and a retaining member disposed along a water facing side of the seawall by adjustably securing the retaining member along a shaft of the anchoring member carrying the anchor and extending through the seawall at a selected non-perpendicular angle.

It is a further object of the present invention to tension an anchoring member longitudinally between an anchor of the anchoring member embedded in retained earth on an earth facing side of a seawall and a retaining member adjustably secured in a selected longitudinal portion along the length of a shaft of the anchoring member extending from the anchor through the seawall at an acute angle with the seawall.

Moreover, it is an object of the present invention to rigidly interconnect at least a pair of anchoring members extending through a seawall at spaced locations to fix the separation distance between the anchoring members.

Yet another object of the present invention is to rigidly interconnect a first anchoring member extending through a seawall to more than one other anchoring members extending through the seawall at spaced locations from the first anchoring member to fix the separation distances between the first anchoring member and the more than one other anchoring members.

It is an additional object of the present invention to adjustably interconnect at least a pair of anchoring members extending through a seawall at spaced locations to adjust the separation distance between the anchoring members and maintain the adjusted separation distance.

The present invention has as a further object to adjustably interconnect a first anchoring member extending through a seawall to more than one other anchoring members extending through the seawall at spaced locations from the first anchoring member to adjust the separation distances between the first anchoring member and the more than one other anchoring members and maintain the adjusted separation distances.

Additionally, it is an object of the present invention to interconnectedly secure a plurality of anchoring members extending through a seawall at spaced locations to one another via connecting members secured on the anchoring members along a water facing side of the seawall.

Another object of the present invention is to close an opening in a seawall by compressing the seawall between anchoring members extending through the seawall on opposite sides of the opening.

Yet a further object of the present invention is to compress a seawall with a desired compressive force between anchoring members extending through the seawall at laterally spaced locations.

The aforesaid objects are achieved individually and in combination, and it is not intended that the present invention be construed as requiring two or more of the objects to be combined unless expressly required by the claims attached hereto.

Some of the advantages of the present invention are that the anchoring devices are installed from the water facing sides of seawalls without the need for excavating or disturbing the earth, removing existing seawalls or seawall portions, adding additional seawalls or seawall portions, water containment, and backfill; the anchoring devices are installed using procedures conducted from the body of water such that the earth facing sides of the seawalls need not be interfered with; the need for cementitious material is eliminated; the anchors can have various configurations including helical formations, arm formations and/or expandable/collapsible formations; any type of earth anchor can be used on the anchoring members; the apparatus and methods of the present invention can be employed on various types of seawalls made of various materials and having various dimensions; the apparatus and methods of the present invention may be used for various aspects of seawall maintenance including the repair of damaged seawalls and as a preventative to avoid damage to existing seawalls not already damaged; the apparatus and methods of the present invention may be used to repair or avoid various types of actual or potential damage to seawalls including movement, shifting or displacement of seawalls, cracked or separated seawalls and misalignment of seawall panels; the apparatus and methods of the present invention may be used for various stages of disrepair in seawalls; depending on the extent of deviation from original specifications, a seawall may be restored to original specifications with a single adjustment performed upon installation of one or more anchoring devices or with multiple incremental adjustments performed dynamically over time following installation of one or more anchoring devices; the apparatus and methods of the present invention may be implemented in accordance with site-specific conditions and engineering requirements; the apparatus and methods of the present invention are particularly advantageous for use where earth-side access is restricted or not viable and/or where replacement of a seawall would entail negative consequences; installation of the anchoring devices may be accomplished using conventional machinery and tools; the number of and locations for the anchoring members installed in a seawall may vary in accordance with individual requirements; the anchoring members may be interlocked in various lateral directions including vertical, horizontal and/or any other angular lateral direction on the seawalls; pairs of anchoring members may be forcefully drawn toward one another in various lateral directions including vertical, horizontal and/or any other angular lateral direction on the seawalls; the shafts of the anchoring members extend through passages formed through the seawalls to facilitate installation; where the cross-sectional sizes of the passages are larger than the cross-sectional sizes of the shafts therethrough, the excess cross-sectional area of the passages not occupied by the shafts may be filled in various ways; ferrules or other structural members may be disposed on the shafts and introduced in the passages with an interference fit to fill the excess cross-sectional area not occupied by the shafts, to support the shafts in the passages and/or to center the shafts in the passages; the retaining members can be designed in various ways for securement on the shafts parallel or non-parallel to the water facing sides of the seawalls; various types of securing members may be used to secure the retaining members on the shafts of the anchoring members; the retaining members may have abutment surfaces configured to abut the water facing sides of the seawalls; various inserts can be inserted or interposed between the retaining members and the water facing sides of the seawalls; the retaining members distribute forces or pressures on the seawalls; the anchoring members can be interlocked by interlocking the retaining members therefor; the retaining members of any two anchoring members can be rigidly interlocked using a fixed length connecting member having opposing ends secured to the retaining members of the two anchoring members, respectively; the retaining members of any two anchoring members can be adjustably interlocked using an adjustable length connecting member having opposing ends secured to the retaining members of the two anchoring members, respectively; the apparatus and methods of the present invention can be used to strengthen existing seawalls for which the depth of penetration of the toe portions is reduced, such as following deepening of the bodies of water on the water facing sides of the seawalls; and the apparatus and methods of the present invention can be used to strengthen existing seawalls for which the height of retained earth is increased on the earth facing sides of the seawalls.

These and other objects, advantages and benefits are realized with the present invention as generally characterized in an apparatus for maintaining a seawall disposed between a body of water and retained earth, the apparatus comprising at least two anchoring devices for being installed on the seawall at spaced locations and a connecting member for rigidly interconnecting the anchoring devices to fix or maintain the separation distance between the anchoring devices. The apparatus may comprise first and second anchoring devices or any number of anchoring devices. Each anchoring device includes an anchoring member and a retaining member. Each anchoring member may comprise a longitudinally extending shaft carrying an anchor having a configuration to anchor the anchoring member in the retained earth. The anchor may comprise any type of earth anchor having various anchor formations including a helical formation, an arm formation and/or a collapsible expandable formation. Each retaining member may comprise a flange having a bore hole therethrough for receiving an end of the shaft of the corresponding anchoring member by which the retaining member is movable longitudinally along the shaft. Each retaining member may have an abutment surface for abutment with a water facing side of the seawall, and the retaining members and the abutment surfaces may have various configurations. Any of the anchoring devices may further include an insert for being interposed between the retaining member and the water facing side of the seawall. Any of the anchoring devices may further comprise a filler for being disposed around the shaft of the anchoring device to fill the passage in the seawall through which the shaft extends when the anchoring device is installed on the seawall. Each retaining member may be secured on the corresponding shaft in various ways using one or more securing structures formed separately from or as part of the retaining member. Securing structures formed separately from the retaining member may comprise a securing member of the anchoring device, and the securing member may include a nut for threadedly engaging the end of the shaft extending from the bore hole of the retaining member. Securing structure formed as part of the retaining member may include a thread along the bore hole for threadedly engaging the end of the shaft.

Each anchoring member is inserted in a passage formed through the seawall and is advanced in the passage into the retained earth to anchor the anchor in the retained earth a distance spaced from an earth facing side of the seawall. The end of each anchoring member extends from the passage along the water facing side of the seawall, and the retaining member is secured on the end of the anchoring member extending from the passage. The retaining members apply compressive force against the seawall by virtue of the seawall and retained earth being compressed between the retaining members and the anchors and by virtue of the anchoring members being tensioned between the retaining members and the anchors. The connecting member rigidly interconnects the ends of the anchoring members to fix or maintain the separation distance between the anchoring members, and the connecting members may be attached to the retaining members of the anchoring devices. The length of the connecting member between the interconnected anchoring members or devices may be fixed or may be adjustable to permit the separation distance between the anchoring members or devices to be selectively adjusted.

The present invention is also generally characterized in a method of maintaining a seawall disposed between a body of water and retained earth involving the steps of forming a passage through the seawall to extend downwardly at an acute angle from a water facing side of the seawall to an earth facing side of the seawall, inserting an anchoring member through the passage from the water facing side and into the retained earth on the earth facing side, advancing the anchoring member into the retained earth to anchor an anchor of the anchoring member in the retained earth at a distance spaced from the earth facing side of the seawall with a longitudinally extending shaft of the anchoring member which carries the anchor extending through the passage along the water facing side of the seawall, and securing a retaining member on an end of the shaft extending from the passage on the water facing side of the seawall to apply compressive force against the water facing side of the seawall to resist displacement of the seawall due to pressure of the retained earth. The method may be performed entirely from a vessel deployed on the body of water without the need for excavation or disturbance of the earth or for earth-side access. Any number of anchoring devices may be installed on the seawall so that the compressive force applied to the seawall is sufficient to strengthen the seawall to resist displacement without the need for cementitious materials for anchoring. The passage may be formed in the seawall by drilling, for example, using a directional drilling machine or any other suitable machinery deployed on the body of water. Advancement of the anchoring member into the retained earth may involve moving the anchoring member into the retained earth longitudinally and/or rotationally. Securing the retaining member on the end of the shaft may involve rotating a securing member on the shaft into compressive engagement with the retaining member with the shaft extending through a bore hole of the retaining member. The method may involve interposing an insert between the retaining member and the water facing side of the seawall. The method may further involve filling the passage around the shaft extending therethrough. Advancement of the anchoring member into the retained earth may involve advancing the anchoring member with the anchor in a collapsed position and moving the anchor from the collapsed position to an expanded position to anchor the anchoring member in the retained earth. The method may comprise periodically adjusting the compressive force of the retaining member against the seawall.

The present invention is further generally characterized in a method of maintaining a seawall disposed between a body of water and retained earth involving installing a first anchoring member on the seawall at a first location, installing a second anchoring member on the seawall at a second location, spaced from the first location, and rigidly interconnecting the anchoring members to maintain the separation distance between the anchoring members. The anchoring members may be installed to extend through the thickness of the seawall with an anchor of each anchoring member anchored in the retained earth at a distance spaced from an earth facing side of the seawall and with an end of each anchoring member extending from a water facing side of the seawall. Installation of the anchoring members may involve securing first and second retaining members on the ends of the first and second anchoring members, respectively, and the first and second anchoring members may be rigidly interconnected by rigidly interconnecting the first and second retaining members. Securement of the retaining members on the anchoring members may involve compressing the seawall and retained earth between the retaining members and the anchors, and the method may involve periodically adjusting the compressive force of the retaining members against the seawall. Rigidly interconnecting the first and second anchoring members may involve adjusting the separation distance between the first and second anchoring members. The method may involve installing the first anchoring member on one side of an opening in the seawall, installing the second anchoring member on an opposite side of the opening, with the step of rigidly interconnecting the first and second anchoring members including drawing the first and second anchoring members toward one another to adjust the separation distance between the anchoring members an amount sufficient to close the opening and maintaining the adjusted separation distance between the first and second anchoring members after the opening is closed. The method may be used to close openings formed by separated cracks or seams in the seawall. The method may involve drawing a pair of interconnected anchoring members together in various directions including vertical and horizontal directions. The method may involve periodically adjusting the separation distance between the anchoring members.

DESCRIPTION OF THE PREFERRED EMBODIMENTS

Figure 1:
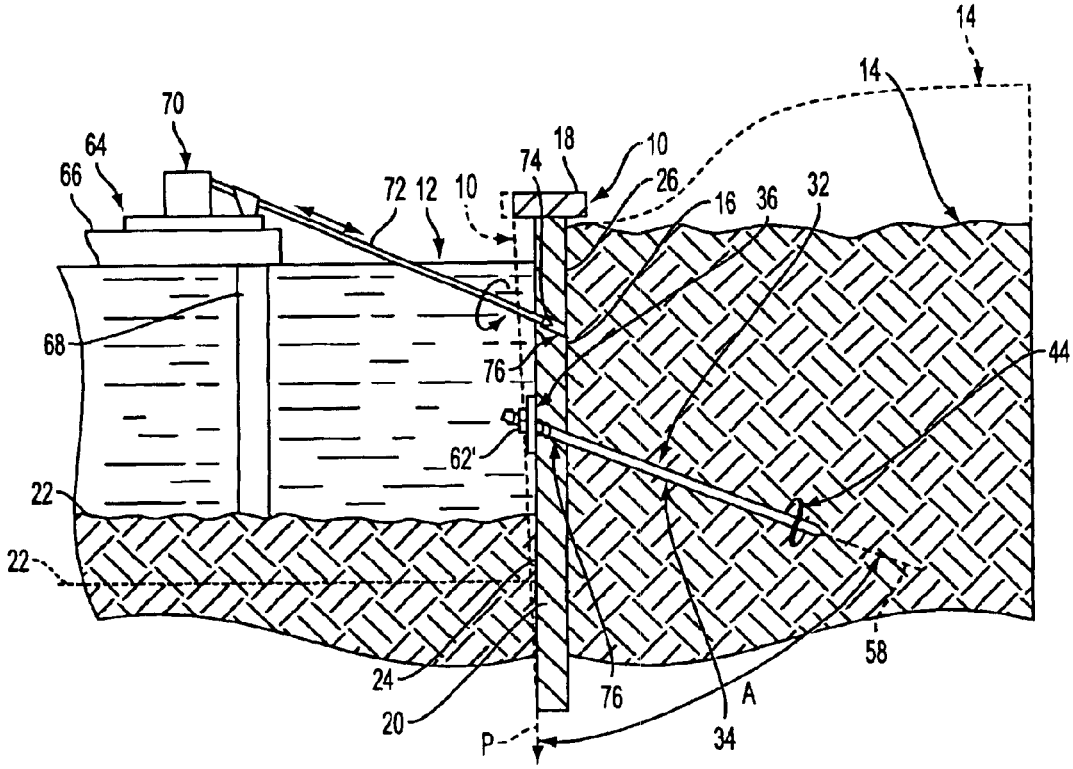
FIG. 1 illustrates an anchoring device and method according to the present invention.
Figure 5:
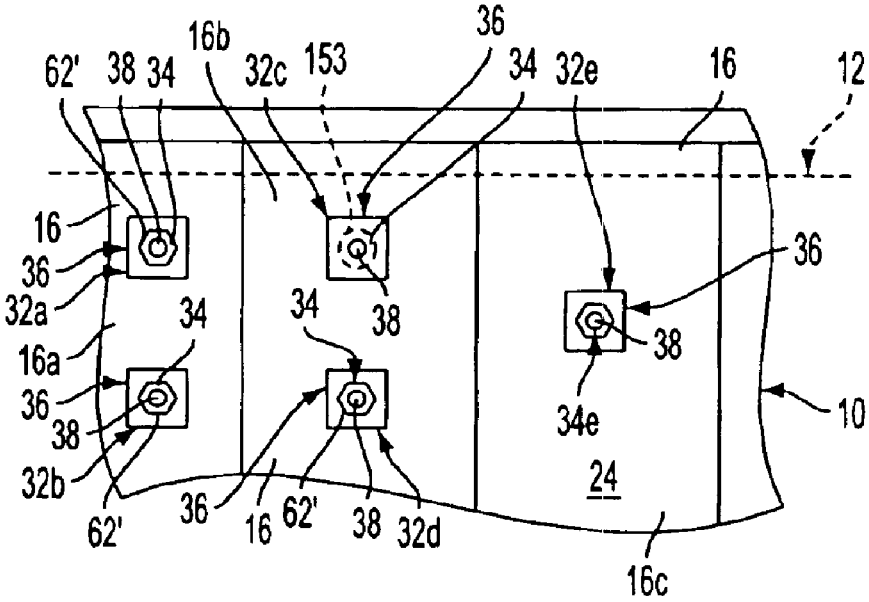
FIG. 5 is a broken plan view of a seawall depicting one arrangement for a plurality of anchoring devices installed thereon.

FIGS. 1 and 5 illustrate a seawall 10 installed in use between a body of water 12 and retained earth 14. Seawall 10 comprises a plurality of seawall panels 16 in side by side abutment. Panels 16 are depicted as being planar with each panel having a height or span in the vertical direction, a width in the horizontal direction and a thickness perpendicular to the height and width. The width of each panel 16 extends between side edges of the panel, and the side edges of adjacent panels 16 may be in abutment as shown in FIG. 5 to form a continuous seawall 10. The seawall 10 has an upper end, which may be finished with a cap 18, normally extending above the water 12, a lower end or toe portion 20 penetrating the earthen floor 22 to extend below the water 12, a water facing side 24 and an earth facing side 26. The distance that the upper portion extends above water 12 will usually depend on the height of retained earth 14 above water 12 and/or anticipated fluctuations in the level of water 12, for example due to tides and/or storms. The toe portion 20 is typically driven into the earthen floor 22 during installation of seawall 10, and the distance the toe portion extends below the water 12 is typically selected in accordance with the depth of body of water 12, the height of retained earth 14 and/or other site-specific conditions to support the seawall in an upright vertical orientation to resist the pressure of retained earth 14.

In one representative seawall, the panels 16 are made of concrete and have a height of about ten to fifteen feet, a width of about four feet and a thickness of about three to five inches. The seawall 10 can be constructed in various alternative ways including, for example, as bulkheads, pilings and/or piers, and of various materials including, for example, steel, wood and concrete. The seawall 10 can have various dimensions. Body of water 12 may be any type of body of water including, for example, oceans, harbors, channels, sounds, rivers and lakes. The retained earth 14 may comprise one or more constituents including, for example, dirt, sand, rock and shells. One representative composition for retained earth 14 is an aggregate of sand and shell. Site-specific conditions may be determined using standard engineering tests and/or calculations, such as soil analysis, from which the force or pressure on seawall 10 from earth 14 can be determined.

The force or pressure exerted on seawall 10 by retained earth 14 is ordinarily greater than the force exerted on seawall 10 by body of water 12 such that the seawall may become damaged or unstable. Damage or instability of seawall 10 may be evidenced by movement, displacement or shifting of seawall 10 from its upright vertical orientation, by openings in the seawall due to cracks in individual seawall panels 16 or separation of adjacent seawall panels 16, and/or by misalignment of seawall panels or cracked portions of panels. Various other conditions may contribute to or cause damage or instability in seawall 10 including collisions or other impacts with the seawall, corrosion and age. Where body of water 12 is deepened after construction of seawall 10, the increased depth of body of water 12 results in a reduced penetration depth for toe portion 20 below earthen floor 22 as shown by dotted line 22 in FIG. 1. Consequently, the seawall 10 may no longer be able to support or retain the retained earth 14 and may be increasingly susceptible to damage or instability. If the height of retained earth 14 is increased as shown by dotted line 14 in FIG. 1, the increased pressure of retained earth exerted on seawall 10 may place the seawall at increased risk of damage or instability. In accordance with the present invention, seawall 10 is maintained by installing one or more anchoring devices to strengthen and repair the seawall where there is actual damage or instability in the seawall and/or to strengthen the seawall to resist potential damage or instability in the seawall from the pressure of earth 14 or other causes. Accordingly, maintenance of a seawall in accordance with the present invention is intended to encompass repair and/or strengthening of a seawall in cases of actual or potential damage or instability arising from the pressure of retained earth and/or other causes.

Figure 2:
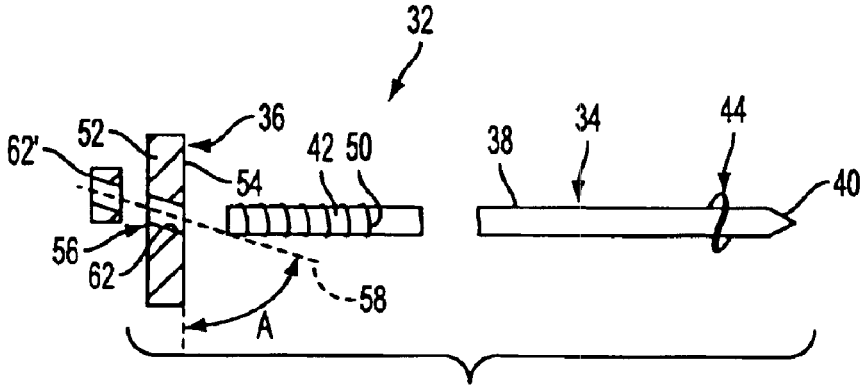
FIG. 2 is a broken, exploded side view of the anchoring device of FIG. 1.

An anchoring device 32 according to the present invention is illustrated in FIGS. 1 and 2 and comprises an anchoring member 34 and a retaining member 36. Anchoring member 34 includes an elongate shaft 38 having a forward end 40, a rearward end 42 and at least one anchor 44 carried on shaft 38. The shaft 38 is longitudinally straight and has a central longitudinal axis. The shaft may have various uniform or non-uniform cross-sections to extend through a passage formed in seawall 10 as explained further below.

Shaft 38 is depicted with a circular cross-section that is uniform or constant along the length of the shaft; however, the cross-section of the shaft can be non-uniform or non-constant along its length. The anchor 44 may be carried on shaft 38 close to or along forward end 40 as shown in FIGS. 1 and 2, but may be disposed at various locations along the length of the shaft. The anchor 44 can have various configurations to anchor the anchoring member 34 in earth 14 and resist withdrawal of the anchoring member from the earth, and any type of earth anchor can be used for anchor 44. The anchor 44 is depicted as comprising a helical formation of sufficient external diameter to anchor the anchoring member 34 in earth 14 and resist withdrawal of the anchoring member from the earth. The helical formation 46 facilitates advancement of the anchoring member 34 in earth 14 via rotation and forward longitudinal movement of the anchoring member. The forward end 40 may terminate at a taper, point or other configuration to facilitate advancement of the anchoring member 34 in earth 14 as described further below. The rearward end 42 may be provided with engagement structure for engagement with securing structure of the anchoring device as described further below. The engagement structure may be designed in various ways, and the engagement structure is depicted by way of example as a thread 50 along the rearward end 42 of the shaft 38. The anchoring member 34 may be made of various materials enabling the anchoring member to sustain preselected torque, compression and tensile forces. Representative materials include galvanized steel and stainless steel.

The retaining member 36 may be designed in various ways to be secured on the rearward end 42 of shaft 38 via securing structure formed separately from or as part of the retaining member. The retaining member 36 includes a flange 52 having a forward abutment surface 54 and a bore hole 56 extending through the flange at an angle to the abutment surface. The flange 52 is depicted as being planar with planar abutment surface 54 for abutment with the planar water facing side 24 of seawall 10. It should be appreciated, however, that the abutment surface and/or the flange can have various non-planar configurations and can have various perimetrical configurations including a square perimetrical configuration as shown in FIG. 5. The bore hole 56 may be centrally or non-centrally located in flange 52 and has a central longitudinal axis 58 disposed at an angle A with the abutment surface 54 as shown in FIG. 2. The bore hole 56 has a cross-sectional configuration and size to receive the rearward end 42 of shaft 38 concentrically therethrough with a close fit. As an example of securing structure formed as part of the retaining member, the retaining member 36 can include securing structure 62 engageable with the engagement structure of shaft 38 to secure the retaining member 36 on the shaft 38 in a desired longitudinal position along the length of the shaft 38. The securing structure formed as part of the retaining member 36 can be designed in various ways and may comprise an internal thread along bore hole 56 threadedly engageable with the external thread 50 of shaft 38. As an example of securing structure formed separately from the retaining member 36, the anchoring device 32 may comprise a securing member 62', such as a nut, having an internal thread along a hole therethrough for threadedly engaging the external thread 50 of shaft 38 and having an external size preventing passage of the securing member through the bore hole 56 of the retaining member. For ease of installation and adjustment, the securing member 62' may be preferable to the securing structure 62, in which case the retaining member 36 can be provided without securing structure 62. When retaining member 36 is disposed on shaft 38 with the shaft 38 extending through bore hole 56, the central longitudinal axis 58 of bore hole 56 and shaft 38 is disposed at angle A with the plane P of abutment surface 54 as shown in FIG. 1. As explained further below, angle A is an acute angle which corresponds to an acute angle selected for the central longitudinal axis of shaft 38 with the water facing side 24 of seawall 10 when the shaft 38 extends angularly downwardly through the thickness of the seawall 10 from the water facing side 24 to the earth facing side 26. As shown in FIG. 2, the central longitudinal axis of the hole through the securing member 62' may be coaxial with axis 58 so that the hole through the securing member is disposed at angle A to a forward face of the securing member 62'. The retaining member 36 and securing member 62' may be made of any suitable materials including galvanized and stainless steels.

A method for maintaining seawall 10 using anchoring device 32 is performed from body of water 12 without the need for excavating or disturbing retained earth 14 or earthen floor 22 and without the need for earth-side access to seawall 10. As shown in FIG. 1, the method can be conducted from a vessel 64, which may be a conventional spud barge having a platform 66 which floats upon the body of water 12 and spuds 68 (only one of which is shown) selectively extendable for lowering from platform 66 into the earthen floor 22 whereby the platform 66 is maintained at a location relative to the water facing side 24 of seawall 10 suitable to conduct the seawall maintenance. The vessel 64 may be towed to the selected location by a tugboat, and the vessel serves as a workstation for equipment, materials and personnel. The spuds 68 may be raised using winches. A directional drilling or boring machine or any other suitable machinery 70 is supported on vessel 64 and includes a drive shaft 72 that is rotatable as well as being movable forwardly and rearwardly in a longitudinal or axial direction for the drive shaft as shown by arrows in FIG. 1. The drive shaft 72 is capable of being positioned at various angles to the seawall 10. A drill bit 74 is carried by a forward end of drive shaft 72 and may be removably coupled or connected to the forward end of drive shaft 72 in any suitable manner. Various couplings or connectors may be provided for removably coupling or connecting the drive shaft 72 to the anchoring member 34 in coaxial relation or alignment, and the drive shaft 72 may also be removably coupleable or connectable with the retaining member 36 using suitable couplings or connectors. Additional machinery and/or tools may be carried by barge 66 as needed to conduct seawall maintenance pursuant to the present invention. The directional drilling machine 70 also includes suitable instruments or gauges for measuring tension, compression and torque.

In accordance with the method of the present invention, the drive shaft 72 carrying drill bit 74 is positioned at the preselected angle A to the seawall 10, and the drive shaft 72 is rotatably driven while being advanced or moved forwardly in a longitudinal or axial direction to form a passage 76 extending entirely through the thickness of seawall 10 from the water facing side 24 to the earth facing side 26 as shown in FIG. 1. The passage 76 has a cross-sectional size to accommodate the anchoring member 34 extending therethrough and, accordingly, a drill bit 74 of appropriate size is selected for formation of the passage 76. The drive shaft 72 is retracted or moved rearwardly in the longitudinal or axial direction for withdrawal from the seawall 10 upon completion of the passage 76. Operation of the machine 70 to control rotation and axial or longitudinal advancement and retraction of the drive shaft 72 may be effected by an operator situated on the vessel 64. A central longitudinal axis of the passage 76 is disposed at angle A with the water facing side 24 of the seawall 10 and extends downwardly from the water facing side 24 to the earth facing side 26. The angle A, the cross-sectional size of the passage 76 and the type and size of anchoring member 34 are predetermined or preselected in accordance with site-specific conditions, engineering tests and/or calculations.

Once the passage 76 has been formed in seawall 10, the drive shaft 72 is coupled or connected with the shaft 38 of anchoring member 34 in coaxial relation or alignment. Coupling or connection of the drive shaft 72 with the shaft 38 may be performed above the water on or from the vessel 64. The drive shaft 72 having the anchoring member 34 coupled or connected thereto is positioned at angle A to seawall 10, and the drive shaft 72 is again advanced in a longitudinal or axial direction to introduce the anchoring member 34, forward end 40 first, into and through the passage 76 from the water facing side 24 to the earth facing side 26 of the seawall 10. The drive shaft 72 is rotated while continuing to be advanced in the longitudinal or axial direction to rotate and advance the anchoring member 34 into the retained earth 14 while the rearward end 42 of the shaft 38 extends from the passage 76 along the water facing side 24 of the seawall 10. The configuration of forward end 40 and anchor 44 of anchoring member 34 facilitate advancement of the anchoring member in earth 14. As it is advanced, the anchoring member 34 contacts the retained earth 14 such that the anchoring member penetrates the retained earth. Accordingly, the portion of the anchoring member 34 extending into the retained earth from the earth facing side of the seawall is embedded in the retained earth 14 without any gap or space between the anchoring member and the surrounding earth. The anchoring member 34 is advanced a preselected or predetermined distance into earth 14 such that anchor 44 is anchored and embedded in earth 14 at a preselected or predetermined distance from the earth facing side 26 of seawall 10. The configuration of anchor 44 embedded in earth 14 resists withdrawal of the anchoring member 34 from the earth 14. The shaft 38 of anchoring member 34 extends through the passage 76, and the eternally threaded rearward end 42 of shaft 38 extends from the passage 46 on the water facing side 24 of seawall 10. As shown in FIG. 1, the rearward end of shaft 38 may extend from the passage 76 into the body of water 12.

Where the seawall 10 is made of a material capable of being cut or penetrated by anchor 44 being driven through passage 76, the cross-sectional size of passage 76 may be made no larger than necessary to accommodate the cross-section of shaft 38 extending therethrough. However, the cross-sectional size of passage 76 may be made larger than necessary to accommodate the cross-section of shaft 38, and may be made large enough to accommodate the cross-section of anchor 44. As described below, anchors may be used which have collapsed positions presenting a relatively small or narrow cross-section and expanded positions presenting a relatively large or wide cross-section as described below, and the passage 76 may be made no larger than necessary to accommodate the cross-section of the anchor in the collapsed position. Where an annular or other gap is presented in passage 76 around shaft 38 due to the cross-sectional size of the passage being larger than the cross-section of the shaft 38 extending therethrough, this gap can be filled with any suitable filler as explained further below. Accordingly, the anchoring device 32 may further comprise a filler, such as the sleeve 153 described below and as shown in FIG. 5.

The retaining member 36 is secured on the rearward end 42 of shaft 38 along the water facing side 24 of seawall 10 with a predetermined torque to obtain a predetermined tension in anchoring member 34 and a predetermined compression against seawall 10 in an anchored position for the anchoring member. The rearward end 42 of shaft 38 is inserted in the borehole 56 of retaining member 36 with the abutment surface 54 of the retaining member facing the water facing side 24 of seawall 10. Where the retaining member 36 is provided with securing structure 62, the retaining member 36 is rotated relative to the shaft 38 in a first rotational direction with the thread 50 on the rearward end 42 in threaded engagement with the thread of borehole 56. Rotation of the retaining member 36 relative to the shaft 38 in the first rotational direction causes forward advancement of the retaining member 36 longitudinally along the shaft 38 toward seawall 10. The retaining member 36 is rotated relative to the shaft 38 in the first rotational direction to a predetermined torque with the abutment surface 54 in abutment with the water facing side 24 of seawall 10 to obtain a predetermined tension in anchoring member 34 and a predetermined compression against seawall 10. The retaining member 36 is secured on the shaft 38 in the longitudinal position corresponding to the predetermined torque, compression and tension due to engagement of thread 50 with the securing structure 62.

Where the anchoring device 32 comprises securing member 62', the rearward end 42 of shaft 38 is inserted in the bore hole 56, which may be provided without the internal thread, with the abutment surface 54 facing the water facing side 24. The retaining member 36 is advanced along the shaft 38 in the direction of the seawall, and the end of shaft 38 extending rearwardly from the bore hole 56 is inserted in the hole of securing member 62' to threadedly engage the internal thread of the securing member 62' with the external thread 50 of shaft 38. The securing member 62' is rotated in a first rotational direction to advance the securing member 62' forwardly along shaft 38 into compressive engagement with the retaining member 36. The securing member 62' is rotated to a predetermined torque with the abutment surface of the retaining member 36 applying a predetermined compression against seawall 10. The securing member 62' and the retaining member 36 are secured on shaft 38 in longitudinal positions corresponding to the predetermined torque, compression and tension, the securing member 62' being held in place due to engagement of its thread with the thread of shaft 38.

When the anchoring device 32 is installed on seawall 10, the seawall 10 and earth 14 between the retaining member 36 and anchor 44 are compressed, and the anchoring member 34 is tensioned between retaining member 36 and anchor 44 to strengthen seawall 10 to resist displacement of the seawall in the direction of water 12. The predetermined torque, compression and tension are selected in accordance with site-specific conditions, the type and/or size of anchoring member, and engineering specifications. Since the central longitudinal axis of bore hole 56 and shaft 38 are disposed at angle A to the abutment surface 54, the abutment surface 54 is in face to face abutment or contact with the water facing side 24 of seawall 10 along plane P, with the central longitudinal axis of shaft 38 extending downwardly from the water facing side 24 to the earth facing side 26.

The retaining member 36 can be secured on the rearward end 42 of shaft 38 at various positions along the length of rearward end 42. Where the retaining member 36 is provided with securing structure 62, the torque, compression and tension can be increased by further rotating the retaining member 36 relative to the shaft 38 in the first rotational direction, and the torque, compression and tension can be decreased by rotating the retaining member 36 relative to shaft 38 in a second rotational direction, opposite the first rotational direction, to cause retraction or rearward movement of the retaining member 36 longitudinally along the shaft 38 in a direction away from seawall 10. When the securing member 62' is used to secure the retaining member 36, the torque, compression and tension can be increased by further rotating the securing member 62' in the first rotational direction, and the torque, compression and tension can be decreased by rotating the securing member 62' in a second rotational direction, opposite the first rotational direction, to cause retraction or rearward movement of the securing member 62' longitudinally along the shaft 38 in the direction away from seawall 10. Accordingly, torque, compression and tension adjustments are possible in the anchoring devices. The retaining member 36 and securing member 62' could be rotated, advanced and retracted via drive shaft 72 using an appropriate connector or coupling to releasably couple or connect the retaining member 36 and/or securing member 62' to the drive shaft 72. The retaining member 36 and securing member 62' can be secured on the anchoring member 34 using any other suitable machinery or tools operated and controlled from the vessel 64.

FIG. 1 depicts anchoring device 32 as a first anchoring device installed on seawall 10 at a first location and depicts drive shaft 72 in the process of drilling another passage 76 through seawall 10 for installation of another or second anchoring device to be installed on seawall 10 at a second location spaced laterally above the first anchoring device 32. In FIG. 1, a portion of rearward end 42 protrudes from the securing member 62' on the water facing side 24 of seawall 10. If desired, this portion can be cut or trimmed following installation of anchoring device 32. However, it may be advantageous to allow this portion to remain intact to facilitate torque, compression and/or tension adjustments of anchoring device 32 conducted following installation. Following installation, the anchoring device 32 can be periodically checked or inspected, and the torque, compression and/or tension can be increased or otherwise adjusted as needed to strengthen seawall 10.

Where seawall 10 is not already damaged or unstable, one or more anchoring devices 32 may be installed on seawall 10 to strengthen the seawall to resist potential damage or instability. The compressive force applied by the one or more anchoring devices 32 against seawall 10 via the intermediary of earth 14 enables the seawall 10 to resist deviation from original design specifications, such as displacement from its upright vertical orientation. Where seawall 10 has already deviated from its original design specifications and experienced actual damage or instability, such as displacement from its upright vertical orientation, the one or more anchoring devices 32 can be used to strengthen the seawall and repair the actual deviation or damage. As an example, dotted lines in FIG. 1 depict seawall 10 displaced from its upright vertical orientation in the direction of water 12 due to the pressure of earth 14. Depending on the amount of displacement of seawall 10 from its original design specifications, sufficient compressive force may be applied against the seawall 10 by the installation of one or more anchoring devices to repair the seawall by moving it to the upright vertical orientation and to strengthen the seawall by resisting displacement from the upright vertical orientation. Accordingly, a seawall that has deviated from its original design specifications may be restored to its original design specifications upon the installation of one or more anchoring devices. More commonly, incremental adjustments made to the one or more anchoring devices over time will be needed to restore a deviated seawall to its original design specifications. One or more anchoring devices 32 can be installed on seawall 10 to repair various types or stages of damage in seawall 10. Where a plurality of anchoring devices 32 are installed on seawall 10, the angle A for the anchoring devices may be the same as or different from each other. Paint, epoxy and/or urethane may be applied to exposed surfaces following installation of one or more anchoring devices for added strength, protection and/or cosmetic enhancement.

Figure 3:
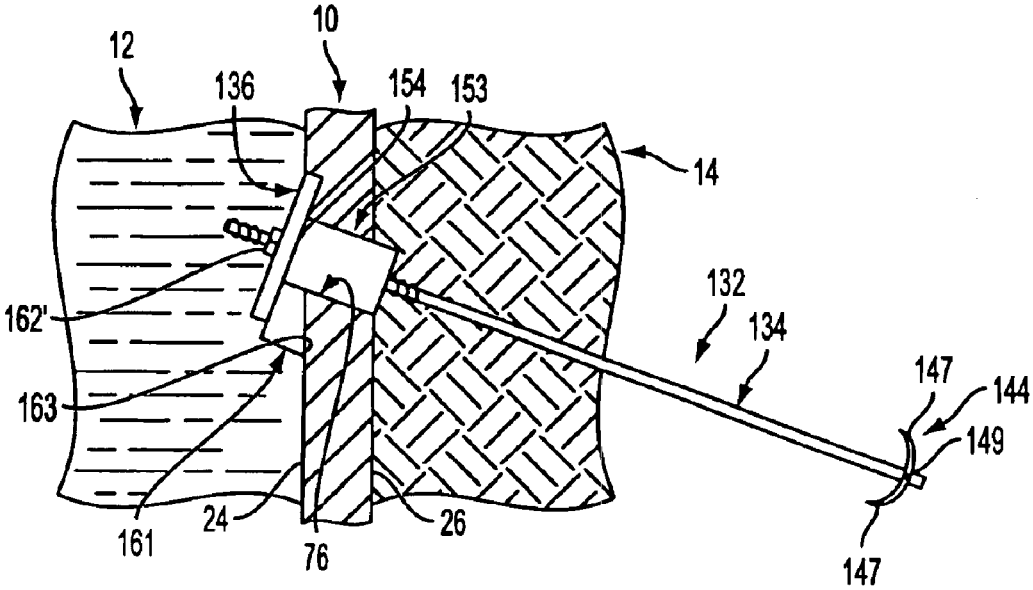
FIG. 3 is a broken side view depicting an alternative anchoring device and method according to the present invention.
Figure 4:
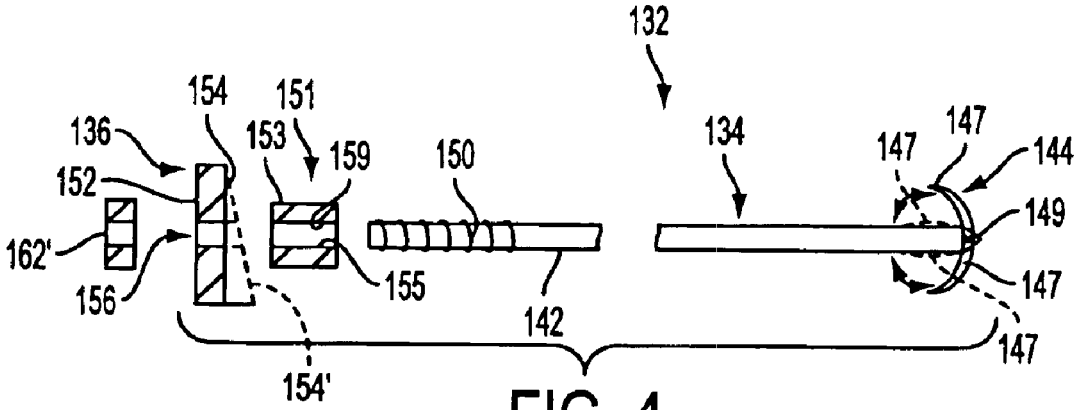
FIG. 4 is a broken, exploded side view of the alternative anchoring device of FIG. 3.

FIGS. 3 and 4 depict an alternative anchoring device 132, the anchoring device 132 being shown in FIG. 3 installed on a seawall 10. Anchoring device 132 comprises anchoring member 134, retaining member 136 and filler 151. Anchoring member 134 is similar to anchoring member 34 except that anchor 144 for anchoring member 134 has an arm formation including a plurality of arms 147 and has a collapsible/expandable formation. Arms 147 have ends pivotally mounted to shaft 138 at a pivot location 149 such that the arms 147 are pivotable relative to the shaft 138 about the pivot location. The arms 147 extend angularly outwardly from the shaft 138 in the rearward direction in an expanded position for anchor 144 shown in FIG. 3 and in solid lines in FIG. 4. In the expanded position, the anchor 144 presents a configuration to resist withdrawal of the anchoring member 134 from earth 14 and, in the expanded position for anchor 144, the anchor presents a relatively large or wide cross-sectional profile. The arms 147 are disposed alongside shaft 138 in a collapsed position for anchor 144 shown in dotted lines in FIG. 4 such that anchor 144 presents a configuration facilitating insertion and advancement of anchoring member 134 through the seawall 10 and into earth 14 during installation. In the collapsed position, anchor 144 presents a relatively small or narrow cross-sectional profile. The anchor 144 is disposed in the collapsed position while the anchoring member 134 is being passed through the seawall 10 and advanced in the earth 14, and the anchor 144 is moved to the expanded position to be embedded in the earth 14 upon the anchoring member 134 being advanced the appropriate distance. Various mechanical mechanisms can be provided for selectively moving the anchor 144 between the collapsed and expanded positions and/or for locking the anchor 144 in the expanded position. The retaining member 136 is similar to retaining member 36 except that the borehole 156 through flange 152 of retaining member 136 is perpendicular to abutment surface 154. The borehole 156 may be threaded for engagement with the thread of shaft 138 or may be without a thread. The anchoring device 132 may include a securing member 162' for securing the retaining member 136 on shaft 138 when the borehole 156 is without a thread. The securing member 162' is similar to securing member 162 except that the threaded hole through securing member 162' is perpendicular to the forward face of the securing member 162'.

The filler 151 comprises a cylindrical ferrule or sleeve 153 having a lumen 155 extending axially therethrough. The lumen 155 has a cross-sectional diameter or size corresponding to the external cross-sectional diameter or size of the rearward end 142 of shaft 138 to receive the shaft 138 therethrough with a close fit. The sleeve 153 has an external diameter or cross-sectional size corresponding to the diameter or cross-sectional size of passage 76 formed in seawall 10 such that the sleeve 153 can be disposed in passage 76 with an interference fit. The sleeve 153 could be provided with engagement structure along lumen 155 for engaging the engagement structure of shaft 138, and such engagement structure may comprise a thread 159 for threaded engagement with the thread 150 on the rearward end of shaft 138.

Installation of anchoring device 132 on seawall 10 in a method of maintaining seawall 10 is similar to that described above for anchoring device 32. A passage 76 of appropriate size is formed through the thickness of seawall 10 at a selected angle for insertion of anchor 144 and shaft 138 therethrough with the anchor 144 maintained in the collapsed position. The anchoring member 134 is advanced into the retained earth 14 the appropriate distance and anchor 144 is moved from the collapsed position to the expanded position whereby the anchor 144 is embedded in the retained earth 14 to resist withdrawal of anchoring member 134. The filler 151 is used to fill the annular gap present in passage 76 around the shaft 138 extending therethrough. Accordingly, the sleeve 153 is positioned on the rearward end 142 of shaft 138 which extends from the water facing side 24 of seawall 10 as accomplished by inserting the rearward end 142 in the lumen 155. The sleeve 153 is advanced longitudinally along the shaft 138 in the direction of seawall 10 so that the sleeve enters passage 76 with an interference fit and thereby fills the gap around shaft 138. The sleeve 153 also supports and centers the shaft 138 in the passage 76. Where the sleeve 153 is provided with thread 159, the sleeve is advanced by being rotated relative to the shaft 138 in a first rotational direction. The longitudinal position of the sleeve 153 along the shaft 138 may be maintained due to threaded engagement of thread 150 with thread 159. The drive shaft 72 of machine 70 or any other suitable machinery and/or tools can be used to position and advance the sleeve 153 on the shaft 138 from vessel 64. The sleeve 153 may be retracted or moved rearwardly along the shaft 138 for longitudinal adjustment and, where the sleeve is provided with thread 159, it may be rotated on shaft 138 in a second rotational direction, opposite the first rotational direction, to cause longitudinal rearward movement of the sleeve along the shaft 138 in a direction away from seawall 10. The sleeve 153 may be made of any suitable material including galvanized and stainless steels. Although filler 151 is depicted as a definitive structural component, it should be appreciated that the filler may comprise any suitable filler material with or without a definitive structural shape.

The retaining member 136 is secured on the portion of rearward end 142 which protrudes from sleeve 153 and the passage 76 on the water facing side of seawall 10 and is used to establish tension in anchoring member 134 and compression against seawall 10 as described above for retaining member 36. Tension in anchoring member 134 and compression against seawall 10 may be established using securing member 162' as described for securing member 62'. Since the bore hole 156 of retaining member 136 is perpendicular to planar abutment surface 154, the abutment surface 154 is at an angle to the water facing side 24 of seawall 10 due to the downward angle of passage 76. Accordingly, the abutment surface 154 is not in face to face abutment with the water facing side 24, and there is a space presented between the abutment surface 154 and the water facing side 24. As shown in FIG. 3, the anchoring device 132 further comprises an insert 161 for being disposed in the space between the abutment surface 154 and the water facing side 24 to transmit force against the seawall 10 from retaining member 136. Insert 161 may have any geometric configuration needed to distribute the force of retaining member 136 against the water facing side 24. In the case of anchoring device 132, the insert 161 has a wedge shaped configuration for being disposed in the angular space presented between abutment surface 154 and water facing side 24 with an abutment surface 163 of the insert facing the water facing side 24. During installation, the retaining member 136 is advanced along shaft 138 with the insert 161 interposed between abutment surface 154 and water facing side 24. The retaining member 136 is advanced along shaft 138 into abutment with the insert 161, which in turn abuts the water facing side 24 via abutment surface 163 and applies compressive force against the seawall as explained above for retaining member 36.

Anchoring device 32 thusly is representative of an anchoring device in which the abutment surface of the anchoring device in contact with the water facing side of the seawall is formed in its entirety by the abutment surface of the retaining member. Anchoring device 132 is representative of an anchoring device in which the abutment surface of the anchoring device in contact with the water facing side of the seawall is formed in part by the abutment surface of the retaining member and in part by an abutment surface of an insert interposed between the retaining member and the water facing side. It should be appreciated that in the anchoring device 132, the abutment surface 154 of retaining member 136 itself can be designed with a configuration 154' corresponding to the configuration resulting from the combination of abutment surfaces 154 and 163 as shown in FIG. 4 so that insert 161 may be eliminated. Accordingly, the abutment surfaces of the anchoring devices which apply force against the seawall may be formed partly or entirely by the abutment surfaces of the retaining members and may be formed partly or entirely by the abutment surfaces of the inserts. The insert 161 can be designed in various ways as one or more parts or materials and may comprise various shoring or shim members.

FIG. 5 illustrates one of many possible arrangements for one or more anchoring devices installed on seawall 10. FIG. 5 depicts a plurality of adjacent seawall panels 16*a*, 16*b* and 16*c* each having one or more anchoring devices installed thereon. Although one or more anchoring devices will typically be installed on each seawall panel, any number of seawall panels 16 which form the seawall 10 can have any number of anchoring devices installed thereon, and some panels may be without anchoring devices. Panel 16*a* has anchoring devices 32*a* and 32*b* installed thereon at first and second spaced locations, respectively, on panel 16*a* laterally spaced from and aligned with each other in the vertical direction. Panel 16*b* is adjacent panel 16*a* and has anchoring devices 32*c* and 32*d* installed thereon, anchoring device 32*c* being depicted without the securing member 62' in order to show sleeve 153. Anchoring devices 32*c* and 32*d* are installed at first and second spaced locations, respectively, on panel 16*b* laterally spaced from and aligned with each other in the vertical direction. In addition, the first and second locations for anchoring devices 32*c* and 32*d* are laterally spaced from and aligned with the first and second locations for anchoring devices 32*a* and 32*b*, respectively, in the horizontal direction. Panel 16*c* is adjacent panel 16*b* and has one anchoring device 32*e* installed thereon at a location laterally spaced from the first and second locations for anchoring devices 32*c* and 32*d*. The location for anchoring device 32*e* is not aligned in the horizontal direction with the first and second locations for anchoring devices 32*c* and 32*d* but, rather, is staggered or offset with respect thereto in the horizontal direction. Anchoring device 32*c* is depicted in dotted lines as including a sleeve 153 as described above. FIG. 5 shows an arrangement where all of the anchoring devices are disposed below water 12; however, it should be appreciated that any or all of the anchoring devices could be disposed above the water depending on site-specific conditions.

Figure 6:
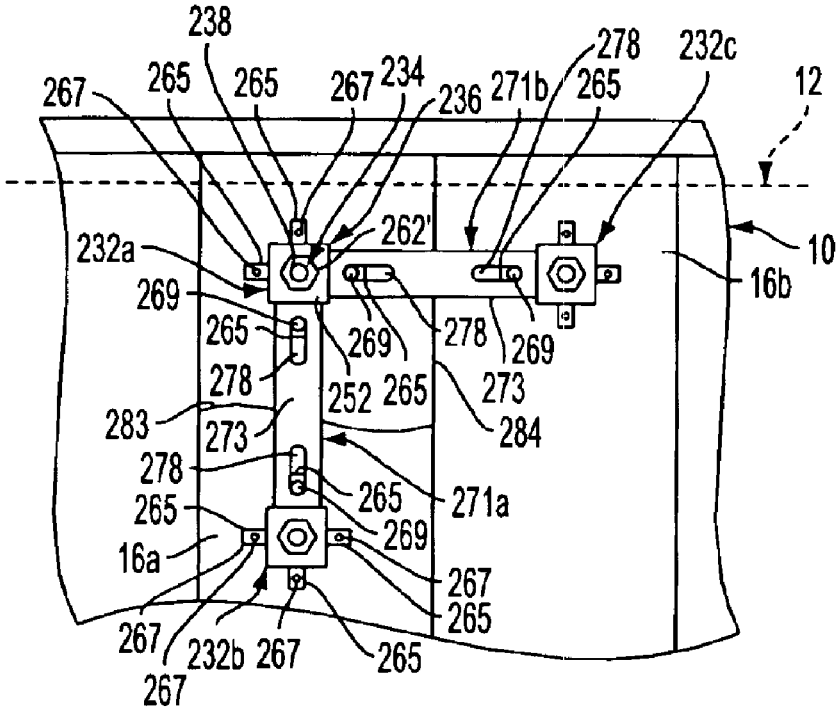
FIG. 6 is a broken plan view of a seawall depicting a plurality of further alternative anchoring devices installed thereon in rigid interconnected relation.

FIG. 6 depicts an apparatus for maintaining a seawall comprising a plurality of alternative anchoring devices, at least one connecting member for interconnecting a pair of the alternative anchoring devices and one or more fasteners for connecting the at least one connecting member to the pair of anchoring devices which are to be interconnected. The apparatus of FIG. 6 comprises first, second and third anchoring devices 232*a*, 232*b* and 232*c* each comprising an anchoring member 234 and a retaining member 236 as shown for anchoring device 232*a*. Each anchoring member 232*a*, 232*b* and 232*c* is also shown as comprising a securing member 262'. The anchoring members 234 may be similar to anchoring members 34 or 134 and include shafts 238 as shown for anchoring device 232*a*. The retaining members 236 may be similar to retaining members 36 or 136 except that each retaining member 236 includes one or more legs 265 extending therefrom. Each retaining member 236 may comprise a flange 252 of square peripheral configuration defined by four straight sides, with there being a leg 265 extending perpendicularly from each side in a direction radial to the bore hole of the flange which receives shaft 238. Each leg 265 has a hole 267 therethrough for receiving a fastener. The securing member 262' may be similar to securing members 62' or 162'. The apparatus of FIG. 6 comprises first and second connecting members 271*a* and 271*b* each comprising a straight, longitudinally extending channel member 273 having first and second opposing ends. A longitudinal slot 278 is formed in each of the first and second ends, the slots 278 being aligned with one another in the longitudinal direction for the channel member. Each slot 278 has a closed inner end and a closed outer end. The channel members 273 are rigid members of fixed predetermined length with a predetermined longitudinal distance between the outer ends of slots 278. The channel members 273 may be made of any suitable material including galvanized and stainless steels. Four fasteners are provided in the apparatus of FIG. 6, each comprising a threaded bolt 269 and a nut (nut shown) threadedly engageable on the bolt 269.

In a method of seawall maintenance using the apparatus of FIG. 6, the anchoring devices 232*a*, 232*b* and 232*c* may be installed on a seawall 10 with the anchoring member of each anchoring device placed in its anchored position in a manner similar to that described above for anchoring devices 32 and 132. FIG. 6 illustrates first and second anchoring devices 232*a* and 232*b* installed on panel 16*a* of seawall 10 and third anchoring device 232*c* installed on panel 16*b* of seawall 10. The first and second anchoring devices 232*a* and 232*b* are installed at laterally spaced first and second locations on seawall 10 on opposite sides of a crack 283 in panel 16*a* which has not yet separated or opened. Since the crack 283 extends in the horizontal direction, the first and second anchoring devices 232*a* and 232*b* are laterally spaced from and aligned with one another in the vertical lateral direction traversing crack 283. The retaining members 236 for anchoring devices 232*a* and 232*b* are positioned so that a leg 265 of first anchoring device 232*a* is aligned with a leg 265 of second anchoring device 232*b* in the vertical lateral direction traversing crack 283, and the aligned legs 265 of the first and second anchoring devices 232*a* and 232*b* extend toward each other from their respective flanges 252. Anchoring device 232*c* is installed on panel 16*b* of seawall 10 at a third location on seawall 10 laterally spaced from and aligned in the horizontal lateral direction with the first location for anchoring device 232*a*. The first anchoring device 232*a* and the third anchoring device 232*c* are installed on opposite sides of a vertically extending seam 284 defined between the side edges of adjacent panels 16*a* and 16*b*, and the seam 284 has not yet separated or opened. The retaining members 236 for anchoring devices 232*a* and 232*c* are positioned so that a leg 265 of first anchoring device 232*a* is aligned with a leg 265 of third anchoring device 232*c* in the horizontal lateral direction traversing seam 284. The aligned legs 265 of the first and third anchoring devices 232*a* and 232*c* extend toward each other from their respective flanges 252.

Following installation of the first and second anchoring devices 232*a* and 232*b* with their anchoring members in their anchored positions, the method of seawall maintenance utilizing the apparatus of FIG. 6 involves rigidly interconnecting the anchoring members 234 of the first and second anchoring devices 232*a* and 232*b* to fix or maintain the separation distance between the anchoring members of the first and second anchoring devices in the vertical lateral direction and rigidly interconnecting the anchoring members 234 of the first and third anchoring devices 232*a* and 232*c* to fix or maintain the separation distance between the anchoring members of the first and third anchoring devices in the horizontal lateral direction. The first connecting member 271*a* is rigidly interconnected to the anchoring members 234 of the first and second anchoring devices 232*a* and 232*b* by aligning the outer ends of slots 278 of the first connecting member 271 a with the holes 267 in aligned legs 265 of the first and second anchoring devices, respectively. Bolt 269 is inserted through each pair of aligned outer ends and holes 267 and are secured in place via nuts, respectively. If desired, the holes 267 in the legs 265 of the anchoring devices may be threaded to threadedly engage the bolts. The first end of the first connecting member 271*a* is adjacent or in abutment with the retaining member 236 of first anchoring device 232*a* and the second end of the first connecting member 271*a* is adjacent or in abutment with the retaining member 236 of second anchoring device 232*b*. Accordingly, the first and second anchoring devices 232*a* and 232*b* are prevented from moving inwardly toward one another in the vertical lateral direction. The anchoring devices 232*a* and 232*b* are prevented from moving outwardly away from one another in the vertical lateral direction due to engagement of bolts 269 with the closed outer ends of the slots 278 of the first connecting member 271*a*. Since the anchoring devices 232*a* and 232*b* are not rigidly interconnected until after installation with their anchoring members in their anchored positions, the tension and compression established with each anchoring device is independent of the tension and compression established in the other.

Following installation of the first anchoring device 232*a* and the third anchoring device 232*c* with their anchoring members in their anchored positions, the second connecting member 271*b* is rigidly interconnected to the anchoring members 234 of the first and third anchoring devices by aligning the outer ends of slots 278 of the second connecting member 271*b* with the holes 267 in the aligned legs 265 of the first and third anchoring devices, respectively. Bolts 269 are inserted through each pair of aligned outer ends and holes 267 in the aligned legs 265 of the first and third anchoring devices and are secured in place via nuts, respectively. The first end of the second connecting member 271*b* is adjacent or in abutment with the retaining member 236 of the first anchoring device 232*a* and the second end of the second connecting member 271*b* is adjacent or in abutment with the retaining member 236 of the third anchoring device 232*c* to prevent movement of the first and third anchoring devices toward one another in the horizontal lateral direction. Movement of the first and third anchoring devices 232*a* and 232*c* away from one another in the horizontal lateral direction is also prevented due to engagement of bolts 269 with the closed outer ends of slots 278 of the second connecting member 271*b*. Again, the tension and compression established with anchoring device 232*a* is independent of that established with anchoring device 232*c* since the anchoring devices are not rigidly interconnected until after the anchoring devices have been installed.

Due to the rigid interlocking connection between the first and second anchoring devices 232*a* and 232*b*, separation, misalignment or other displacement of crack 283 is prevented. Due to the rigid interlocking connection between the first and third anchoring devices 232*a* and 232*c*, separation, misalignment or other displacement of seam 284 is prevented. It should be appreciated that the legs 265 can extend from the retaining members 236 in any desired lateral direction to fix or maintain a desired separation distance between a pair of interconnected anchoring devices in any desired lateral direction. Any suitable machinery and/or tools can be used to secure the connecting members to the anchoring devices in interconnected relation from vessel 64. The anchoring devices 232*a*, 232*b* and 232*c* can be inspected or checked periodically and torque, compression and tension adjustments can be made along with adjustments to the fasterners, as needed.

Figure 7:
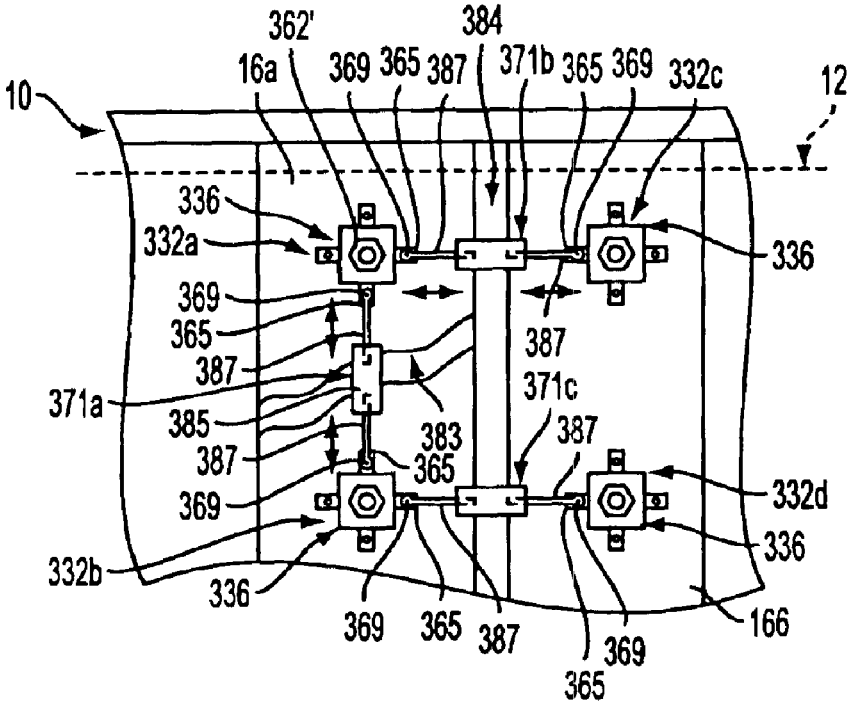
FIG. 7 is a broken plan view of a seawall having openings therein and depicting additional alternative anchoring devices installed thereon in pairs on opposite sides of the openings in adjustable interconnected relation.
Figure 8:
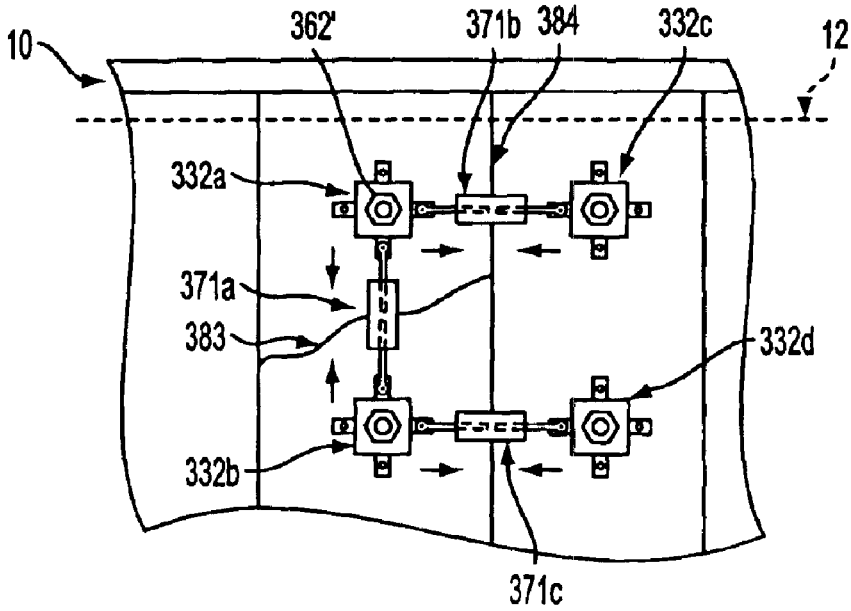
FIG. 8 is a broken plan view of the seawall of FIG. 7 depicting the interconnected pairs of additional alternative anchoring devices drawn toward one another to close the openings.

A further alternative apparatus for seawall maintenance is shown in FIGS. 7 and 8 and is similar to the apparatus depicted in FIG. 6 except for the number of anchoring devices and connecting members and except for the connecting members of the apparatus of FIGS. 7 and 8 having an adjustable length. The apparatus of FIGS. 7 and 8 comprises first, second, third and fourth anchoring devices 332*a*, 332*b*, 332*c* and 332*d* which are similar to the anchoring devices 232*a*, 232*b* and 232*c*. The apparatus of FIGS. 7 and 8 comprises first, second and third connecting members 371*a*, 371*b* and 371*c*, each comprising a turnbuckle or other adjustment mechanism. As shown for connecting member 371*a*, each connecting member 371*a*, 371*b* and 371*c* comprises an actuator or housing 385 having opposed ends, respectively, threadedly receiving the stems of adjustment members 387 terminating at eye formations at opposed first and second ends of the connecting member. The housing 385 is rigid and has a straight longitudinally extending configuration mounting straight stems extending longitudinally from the opposed ends of the housing 385 in longitudinal alignment with one another but in opposite directions. The housing 385 may be cylindrical or any suitable configuration. The adjustment members 387 are rigid with the eye formations being in line with the stems thereof. The stems and, therefore, the adjustment members 387, are longitudinally extendable from the housing 385 when the housing is rotated in a first rotational direction relative to the adjustment members 387 while being longitudinally retractable in the housing 385 when the housing is rotated relative to the adjustment members 387 in a second rotational direction, opposite the first rotational direction, as shown by arrows in FIG. 7. The apparatus depicted in FIGS. 7 and 8 includes fasteners for connecting the first and second ends of each connecting member with a pair of anchoring devices, and the fasteners may each comprise a bolt 369 and nut (not shown) similar to the fasteners of the apparatus of FIG. 6.

In a method of seawall maintenance using the apparatus of FIGS. 7 and 8, the anchoring devices 332*a*, 332*b*, 332*c* and 332*d* may be installed on a seawall 10 in a manner similar to that described above for anchoring devices 232*a*, 232*b* and 232*c*. FIG. 7 illustrates first and second anchoring devices 332*a* and 332*b* installed on panel 16*a* of seawall 10 and third and fourth anchoring devices 332*c* and 332*d* installed on adjacent panel 16*b* of seawall 10. The first and second anchoring devices 332*a* and 332*b* are installed at laterally spaced first and second locations on seawall 10 on opposite sides of a horizontally extending crack 383 in seawall panel 16*a* which has separated or opened to present an opening between upper and lower portions of panel 16*a*. Since the crack 383 extends in the horizontal direction, the first and second anchoring devices 332*a* and 332*b* are laterally spaced from and aligned with one another in the vertical lateral direction traversing the crack 383. The retaining members 336 for anchoring devices 332*a* and 332*b* are positioned so that a leg 365 of first anchoring device 332*a* is aligned with a leg 365 of second anchoring device 332*b* in the vertical lateral direction traversing crack 383. The aligned legs 365 of the first and second anchoring devices 332*a* and 332*b* extend toward each other from the flanges of their respective retaining members 336.

Anchoring device 332*c* is installed on panel 16*b* of seawall 10 at a third location on seawall 10 laterally spaced from and aligned in the horizontal lateral direction with the first location for anchoring device 332*a*. First anchoring device 332*a* and third anchoring device 332*c* are installed on opposite sides of a vertically extending seam 384 defined between the side edges of adjacent panels 16*a* and 16*b*, and the seam 384 has separated or opened to present an opening between the panels 16*a* and 16*b*. The retaining members 336 for anchoring devices 332*a* and 332*c* are positioned so that a leg 365 of first anchoring device 332*a* is aligned with a leg 365 of a third anchoring device 332*c* in the horizontal lateral direction traversing seam 384. The aligned legs 365 of the first and third anchoring devices extend toward each other from the flanges of their respective retaining members 336. Anchoring device 332*d* is installed on panel 16*b* at a fourth location on seawall 10 laterally spaced from and aligned in the horizontal lateral direction with the second location for anchoring device 332*b*. The second anchoring device 332*b* and the fourth anchoring device 332*d* are installed on opposite sides of the seam 384. The retaining members 336 for anchoring devices 332*b* and 332*d* are positioned so that a leg 365 of second anchoring device 332*b* is aligned with a leg 365 of fourth anchoring device 332*d* in the horizontal lateral direction traversing seam 384. The aligned legs 365 of the second and fourth anchoring devices 332*b* and 332*d* extend toward each other from the flanges of their respective retaining members 336. The third and fourth anchoring devices 332*c* and 332*d* are in vertical alignment with one another on seawall panel 16*b*.

A method of seawall maintenance utilizing the apparatus of FIGS. 7 and 8 further involves adjustably rigidly interconnecting the anchoring members of the first and second anchoring devices 332*a* and 332*b*, adjustably rigidly interconnecting the anchoring members of the first and third anchoring devices 332*a* and 332*c*, and adjustably rigidly interconnecting the anchoring members of the second and fourth anchoring devices 332*b* and 332*d*. Following installation of the first and second anchoring devices 332*a* and 332*b*, the first connecting member 371*a* is interconnected to the anchoring members of the first and second anchoring devices by aligning the eye formations of the first connecting member with the holes in the aligned legs of the first and second anchoring devices. A bolt 369 is inserted through each pair of aligned eye formations and holes and the bolts are respectively secured with nuts. With the first and second ends of the first connecting member 371*a* thusly secured to the aligned legs 365 of the first and second anchoring devices 332*a* and 332*b*, the housing 385 of the first connecting member 371*a* is rotated in the first rotational direction to retract the adjustment members 387 thereof into the housing whereby the anchoring members of the first and second anchoring devices are moved or drawn toward one another in the vertical lateral direction as shown by arrows in FIG. 8. The adjustment members 387 of the first connecting member 371*a* are retracted into the housing 385 an amount sufficient to draw the anchoring members of the first and second anchoring devices 332*a* and 332*b* together a distance sufficient to move the upper and lower portions of panel 16*a* toward one another to close or reduce the size of the opening of crack 383 as shown in FIG. 8. Once the first and second anchoring devices 332*a* and 332*b* have been drawn together to close or reduce the size of crack 383 with a desired compressive force, the separation distance between the first and second anchoring members 3321 and 332*b* in the vertical lateral direction is fixedly maintained by the first connecting member 371*a* due to threaded engagement of the stems of the adjustment members 387 and the housing 385.

Following installation of the first anchoring device 332*a* and the third anchoring device 332*c*, the second connecting member 371*b* is interconnected to the anchoring members of the first and third anchoring devices 332*a* and 332*c* by aligning the eye formations of the second connecting member 371*b* with the holes in the aligned legs 365 of the first and third anchoring devices and securing the eye formations to the aligned legs 365 using bolts 369 and nuts as described for the first connecting member 371*a*. The housing 385 for the second connecting member 371*b* is rotated in the first rotational direction to retract the stems of the second connecting member into the housing thereby moving or drawing the anchoring members of the first and third anchoring devices 332*a* and 332*c* toward one another in the horizontal lateral direction to correspondingly draw panels 16*a* and 16*b* toward one another to close or reduce the size of the opening of seam 384 as shown in FIG. 8. Once the opening of seam 384 has been closed or reduced in size with a desired compressive force, the longitudinal separation distance between the anchoring members of the first and third anchoring devices 332*a* and 332*c* in the horizontal lateral direction is fixedly maintained by the second connecting member 371*b*. The anchoring members of the second and fourth anchoring devices 332*b* and 332*d* are drawn together using third connecting member 371*c* to close or reduce the size of the opening of seam 384 and thereafter maintain a fixed separation distance between the anchoring members of the second and fourth anchoring devices as described for the second connecting member 371*b* and the first and third anchoring devices 332*a* and 332*c*. The second and fourth anchoring devices can be drawn together simultaneously, sequentially or in alternating increments with the first and third anchoring devices. Since the stems are extendable from the housings 385, the separation distance between interconnected pairs of anchoring devices can be adjusted. Accordingly, the connecting members 371*a*, 371*b* and 371*c* can be used to separate seawall panels or seawall panel portions by moving seawall panels or seawall panel portions away from one another by rotating the housing 385 in the second rotational direction. Various machinery and/or tools can be used to secure the connecting members 371*a*, 371*b* and 371*c* to the anchoring devices and to effect actuation of the adjustment members 387 via rotation of the housing 385 from the vessel 64. Depending on the size of the opening in the seawall, the opening may be completely closed with one adjustment of interconnected anchoring members. More commonly, an opening will be closed incrementally over time with periodic adjustments of interconnected anchoring members With the methods of the present invention, compressive force may be applied against a seawall by one or more anchoring devices sufficient to prevent displacement of the seawall without the need for cementitious material to assist in anchoring. The methods of the present invention can be conducted entirely from a vessel located on the body of water without the need for excavation or disturbance of the earth, earth-side access to the seawall or underwater diving. The methods can be used to strengthen various types of seawalls to resist potential damage and to correct various types and stages of actual damage. The anchors can have various configurations to anchor the anchoring members in the retained earth, and the retaining members can have various configurations. The retaining members can be secured on the anchoring members in various ways including the use of securing members threaded onto the ends of the anchoring members. Where a gap is presented around the anchoring member in the passage through the seawall, various types of fillers can be used to fill the gap. The fillers can include structural components or filler materials not having a definitive structural shape. The retaining members may comprise flanges having various planar or non-planar configurations, and the abutment surfaces of the retaining members can have various configurations. The anchoring devices may include various inserts insertable between the retaining members and the water facing side of the seawall. The retaining members distribute force or pressure against the seawall to resist displacement thereof. Any number of anchoring devices can be installed in a seawall at various locations and in various arrangements. Any pair of anchoring devices can be rigidly interconnected to maintain a fixed separation distance between the anchoring devices. Any pair of anchoring devices may be interconnected using a connecting member which permits adjustment of the separation distance between the interconnected anchoring devices. Adjustable connecting members may be provided which permit the separation distance between interconnected anchoring devices to be increased and/or decreased. Anchoring devices can be installed on relatively movable portions of a seawall and adjustably interconnected to effect movement of the relatively movable portions and thereafter maintain the adjusted position of the relatively movable portions. Adjustably interconnected anchoring devices can be used to close various types of openings in seawalls including openings between seawall panel portions and between seawall panels. Adjustably interconnected anchoring devices can also be used to separate relatively movable portions of a seawall including relatively movable panels or panel portions. The type of anchoring device or devices utilized and the torque, compression and tension for the anchoring device or devices may be selected in accordance with site-specific conditions and engineering specifications. Following initial installation, the anchoring devices and apparatus of the present invention can be checked or inspected periodically and adjustments may be made as needed to maintain or obtain a desired torque, compression and/or tension. Deviations from original design specifications can be corrected in seawalls using the anchoring devices to apply the necessary corrective forces. A deviation from original design specifications can be corrected at one time in a single application of corrective force or forces using one or more devices, or may be corrected dynamically or incrementally over a period of time in multiple applications of corrective force or forces using one or more anchoring devices, much in the manner of orthodontia.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A method of maintaining a seawall installed in use between a body of water and retained earth, comprising the steps of forming a passage through the installed seawall to extend downwardly at an acute angle from a water facing side of the seawall to an earth facing side of the seawall;

inserting a longitudinally extending shaft of an anchoring member through the passage from the water facing side of the seawall and into the retained earth on the earth facing side of the seawall, with the shaft carrying an anchor of the anchoring member;

advancing the anchoring member into the retained earth while an end of the shaft extends from the passage along the water facing side of the seawall, said advancing including contacting the retained earth with the anchoring member such that the anchoring member penetrates the retained earth and the portion of the anchoring member extending into the retained earth from the earth facing side of the seawall is embedded in the earth;

anchoring the anchor of the anchoring member in the retained earth at a distance spaced from the earth facing side of the seawall with the end of the shaft extending from the passage along the water facing side of the seawall; and securing a retaining member on the end of the shaft, said securing including tensioning the anchoring member between the anchor and the retaining member and compressing the seawall and the retained earth between the anchor and the retaining member to resist displacement of the seawall due to pressure of the retained earth against the earth facing side thereof.

2. The method of maintaining a seawall as recited in claim 1 wherein said forming includes drilling through the thickness of the seawall using a drilling machine.

3. The method of maintaining a seawall as recited in claim 2 wherein said forming includes drilling while the drilling machine is deployed on the body of water.

4. The method of maintaining a seawall as recited in claim 1 wherein said advancing includes moving the shaft longitudinally into the retained earth.

5. The method of maintaining a seawall as recited in claim 4 wherein said advancing includes rotating the shaft into the retained earth.

6. The method of maintaining a seawall as recited in claim 1 wherein said anchoring includes embedding a helical formation of the anchor in the retained earth to resist withdrawal of the anchoring member from the retained earth.

7. The method of maintaining a seawall as recited in claim 1 wherein said advancing includes advancing the anchoring member into the retained earth with the anchor in a collapsed position and said anchoring includes moving the anchor to an expanded position resisting withdrawal of the anchoring member from the retained earth.

8. The method of maintaining a seawall as recited in claim 1 wherein said securing includes threadedly engaging a securing member on the end of the shaft with the retaining member disposed between the water facing side of the seawall and the securing member, said threadedly engaging including engaging the securing member on the shaft at a longitudinal position along the shaft to apply compressive force against the retaining member which is transmitted to the seawall.

9. The method of maintaining a seawall as recited in claim 8 wherein said threadedly engaging includes tensioning the anchoring member between the anchor and the retaining member.

10. The method of maintaining a seawall as recited in claim 1 and further including introducing a filler into the passage around the shaft.

11. The method of maintaining a seawall as recited in claim 1 wherein said securing includes inserting an insert between the retaining member and the water facing side of the seawall and securing the retaining member on the end of the shaft with the insert interposed between the retaining member and the water facing side of the seawall to apply compressive force from the retaining member against the water facing side of the seawall.

12. The method of maintaining a seawall as recited in claim 1 and further comprising, subsequent to said securing, periodically inspecting the seawall and periodically adjusting the retaining member along the shaft to adjust the tension and compression.

13. The method of maintaining a seawall as recited in claim 1 wherein said forming is performed on a seawall that has become displaced from a previous desired position for the seawall and said securing includes moving the seawall back toward the previous desired position.

14. The method of maintaining a seawall as recited in claim 1 wherein said forming, said advancing, said anchoring and said securing are performed for a sufficient number of anchoring members on a seawall that has become displaced from a previous desired position for the seawall, such that the seawall is moved back to the previous desired position.

15. A method of maintaining a seawall installed in use between a body of water and retained earth, comprising the steps of installing a first anchoring member to extend through the installed seawall and into the retained earth, said installing including installing the first anchoring member from a water facing side of the seawall at a first location and tensioning the first anchoring member to compress the seawall against the retained earth;

installing a second anchoring member to extend through the seawall and into the retained earth, said installing a second anchoring member including installing the second anchoring member from the water facing side of the seawall at a second location spaced from the first location and tensioning the second anchoring member to compress the seawall against the retained earth; and subsequent to installing the first and second anchoring members, rigidly interconnecting the first and second anchoring members to maintain a separation distance between the first and second anchoring members.

16. The method of maintaining a seawall as recited in claim 15 wherein said installing a first anchoring member comprises anchoring an anchor of the first anchoring member in the retained earth at a distance spaced from an earth facing side of the seawall with an end of the first anchoring member extending from the water facing side of the seawall and securing a first retaining member on the end of the first anchoring member, said installing a second anchoring member comprises anchoring an anchor of the second anchoring member in the retained earth at a distance spaced from the earth facing side of the seawall with an end of the second anchoring member extending from the water facing side of the seawall and securing a second retaining member on the end of the second anchoring member, and said rigidly interconnecting comprises rigidly interconnecting the first and second retaining members.

17. The method of maintaining a seawall as recited in claim 16 wherein said securing a first retaining member includes tensioning the first anchoring member between the first retaining member and the anchor of the first anchoring member and compressing the seawall and the retained earth between the first retaining member and the anchor of the first anchoring member and said securing a second retaining member includes tensioning the second anchoring member between the second retaining member and the anchor of the second anchoring member and compressing the seawall and the retained earth between the second retaining member and the anchor of the second anchoring member.

18. The method of maintaining a seawall as recited in claim 16 wherein said rigidly interconnecting includes connecting a first end of a connecting member to the first retaining member and connecting a second end of the connecting member to the second retaining member with the connecting member having a fixed length between the first and second retaining members such that the size of the separation distance maintained between the first and second anchoring members is non-variable once the connecting member has been connected to the first and second retaining members.

19. The method of maintaining a seawall as recited in claim 16 wherein said rigidly interconnecting includes connecting a first end of a connecting member to the first retaining member and connecting a second end of the connecting member to the second retaining member with the connecting member having a selectively adjustable length between the first and second retaining members such that the size of the separation distance maintained between the first and second anchoring members is selectively variable once the connecting member has been connected to the first and second retaining members.

20. The method of maintaining a seawall as recited in claim 15 and further including installing a third anchoring member to extend through the seawall and into the retained earth, said installing a third anchoring member including installing the third anchoring member from the water facing side of the seawall at a third location spaced from the first and second locations and tensioning the third anchoring member to compress the seawall against the retained earth and, subsequent to installing the third anchoring member, rigidly interconnecting the third anchoring member to at least one of the first and second anchoring members to maintain a separation distance between the third anchoring member and the at least one of the first and second anchoring members.

21. A method of maintaining a seawall disposed between a body of water and retained earth, comprising the steps of installing a first anchoring member to extend through the seawall from a water facing side to an earth facing side of the seawall at a first location disposed on one side of an opening in the seawall;

installing a second anchoring member to extend through the seawall from the water facing side to the earth facing side at a second location spaced from the first location and disposed on an opposite side of the opening; and rigidly interconnecting the first and second anchoring members to maintain a separation distance between the first and second anchoring members, said rigidly interconnecting including drawing the first and second anchoring members toward one another to reduce the size of the opening and maintaining the separation distance between the first and second anchoring members when the opening is reduced in size.

22. The method of maintaining a seawall as recited in claim 21 and further including, subsequent to said rigidly interconnecting, periodically inspecting the seawall, periodically further drawing the first and second anchoring members toward one another to further reduce the size of the opening, and maintaining the separation distance between the first and second anchoring members each time the opening is further reduced in size.

23. The method of maintaining a seawall as recited in claim 21 wherein said drawing includes closing the opening.

24. Apparatus for maintaining a seawall installed in use between a body of water and retained earth, comprising a first anchoring device comprising a first anchoring member and a first retaining member, said first anchoring member comprising a longitudinally extending shaft and an anchor carried by said shaft for being anchored in the retained earth at a distance spaced from an earth facing side of the installed seawall with an end of said shaft extending from a water facing side of the seawall at a first location, said first retaining member being securable on said end of said shaft at a selected location along the length of said shaft to establish tension in said first anchoring member between said anchor and said first retaining member and compression in the seawall and retained earth between said anchor and said first retaining member in an anchored position for said first anchoring member;

a second anchoring device comprising a second anchoring member and a second retaining member, said second anchoring member comprising a longitudinally extending shaft and an anchor carried by said shaft of said second anchoring member for being anchored in the retained earth at a distance spaced from the earth facing side of the seawall with an end of said shaft of said second anchoring member extending from the water facing side of the seawall at a second location, spaced from the first location, said second retaining member being securable on said end of said shaft of said second anchoring member at a selected location along the length of said shaft of said second anchoring member to establish tension in said second anchoring member between said anchor of said second anchoring member and said second retaining member and compression in the seawall and retained earth between said anchor of said second anchoring member and said second retaining member in an anchored position for said second anchoring member, said tension and compression established in said anchored position for said second anchoring member being independent of said tension and compression established in said anchored position for said first anchoring member; and a connecting member securable to said first and second retaining members while said first and second anchoring members are in said anchored position to maintain a separation distance between said first and second anchoring members.

25. The apparatus for maintaining a seawall as recited in claim 24 wherein said first anchoring device further comprises a first securing member threadedly securable on said end of said shaft of said first anchoring member with said first retaining member disposed on said shaft of said first anchoring member between said first securing member and the water facing side of the seawall, and said second anchoring device further comprises a second securing member threadedly securable on said end of said shaft of said second anchoring member with said second retaining member disposed on said shaft of said second anchoring member between said second securing member and the water facing side of the seawall, said first and second securing members being effective to respectively tension said first and second anchoring members and to compress the seawall and retained earth between said anchors and said first and second retaining members in said anchored positions for said first and second anchoring members.

26. The apparatus for maintaining a seawall as recited in claim 24 wherein said connecting member includes a first end securable to said first retaining member, a second end securable to said second retaining member, and a fixed length between said first and second retaining members to maintain a separation distance of non-variable size.

27. The apparatus for maintaining a seawall as recited in claim 24 wherein said connecting member includes a first end securable to said first retaining member, a second end securable to said second retaining member, and an adjustable length between said first and second retaining members for selectively adjusting the size of the separation distance to be maintained between said first and second anchoring members.

28. The apparatus for maintaining a seawall as recited in claim 27 wherein said connecting member comprises a turnbuckle.

29. The apparatus for maintaining a seawall as recited in claim 24 wherein at least one of said first and second anchoring devices further comprises a sleeve for receiving said shaft of said anchoring member of said at least one of said first and second anchoring devices therethrough and for extension through the seawall with an interference fit to remain in place in the seawall in said anchored position for said anchoring member of said at least one of said first and second anchoring devices.

30. The apparatus for maintaining a seawall as recited in claim 24 wherein at least one of said first and second anchoring devices further comprises an insert for being interposed between said retaining member of said at least one of said first and second anchoring devices and the water facing side of the seawall.

31. The apparatus for maintaining a seawall as recited in claim 24 wherein said anchors of said first and second anchoring members comprise helical formations, respectively.

32. The apparatus for maintaining a seawall as recited in claim 24 wherein said anchors of said first and second anchoring members are each movable between a collapsed position and an expanded position in which said anchors are anchored in the retained earth in said anchored positions for said first and second anchoring members.

* * * * *